US007814624B2

(12) United States Patent
Kitano

(10) Patent No.: US 7,814,624 B2
(45) Date of Patent: Oct. 19, 2010

(54) SELF DRAINING SNAP FASTENER SOCKETS

(75) Inventor: Katsashi Kitano, Lexington, KY (US)

(73) Assignee: YKK Corporation, Tokyo (JP)

( * ) Notice: Subject to any disclaimer, the term of this patent is extended or adjusted under 35 U.S.C. 154(b) by 751 days.

(21) Appl. No.: 11/656,868

(22) Filed: Jan. 23, 2007

(65) Prior Publication Data

US 2008/0175690 A1 Jul. 24, 2008

(51) Int. Cl.
*F16B 21/18* (2006.01)

(52) U.S. Cl. ..... 24/674; 24/681; 24/106

(58) Field of Classification Search ..... 24/104, 24/106, 108, 676, 674, 664, 662, 691, 113 MP, 24/671, 681; 411/115
See application file for complete search history.

(56) References Cited

U.S. PATENT DOCUMENTS

| | | | | | |
|---|---|---|---|---|---|
| 2,015,049 | A | * | 9/1935 | Carr | 24/681 |
| 2,189,995 | A | * | 2/1940 | Reiter | 24/681 |
| 2,552,764 | A | * | 5/1951 | Bedford, Jr. | 24/674 |
| 2,648,885 | A | * | 8/1953 | Jones | 24/681 |
| 2,673,382 | A | * | 3/1954 | Murphy | 24/674 |
| 3,083,430 | A | * | 4/1963 | Shears | 24/662 |
| 3,574,958 | A | | 4/1971 | Martuch | |
| 3,999,257 | A | | 12/1976 | Ishizaki | |
| 4,430,777 | A | * | 2/1984 | Takeda | 24/681 |
| 4,498,827 | A | | 2/1985 | Mair | |
| 4,571,781 | A | | 2/1986 | Kanzaka et al. | |
| 4,686,749 | A | | 8/1987 | Fukuroi et al. | |
| 4,698,881 | A | | 10/1987 | Watanabe | |
| 4,751,771 | A | * | 6/1988 | Watanabe | 24/95 |
| 5,101,541 | A | | 4/1992 | Watanabe | |
| 5,159,719 | A | | 11/1992 | Aumann | |
| 5,212,851 | A | * | 5/1993 | Wantanabe | 24/108 |
| 6,067,694 | A | * | 5/2000 | Candotti | 24/662 |
| 6,247,209 | B1 | * | 6/2001 | Pferdehirt | 24/113 MP |
| 2006/0130289 | A1 | | 6/2006 | Tracy | |

FOREIGN PATENT DOCUMENTS

| | | |
|---|---|---|
| EP | 0 482 346 | 5/1994 |
| JP | 57-85910 | 5/1982 |

* cited by examiner

*Primary Examiner*—Robert J Sandy
*Assistant Examiner*—Rowland D Do
(74) *Attorney, Agent, or Firm*—Alston & Bird LLP

(57) ABSTRACT

A self draining snap fastener socket allows water and other liquids to drain from inside of the self draining snap fastener socket. The self draining snap fastener socket has a snap action attachment/detachment portion defining a channel for a resilient snap member. The channel has an annular side wall extending generally along an axial direction of the self draining snap fastener socket, an upper flange extending from an upper portion of the annular side wall toward a socket center, and a lower flange extending from a lower portion of the annular side wall toward the socket center. A fluid passageway extends from the interior of the self draining snap fastener socket through the annular side wall to outside of the self draining snap fastener socket.

12 Claims, 3 Drawing Sheets

SELF DRAINING SNAP FASTENER SOCKETS

BACKGROUND OF THE INVENTION

The present invention generally pertains to snap fasteners. More specifically, the present invention pertains to self draining snap fastener sockets. In embodiments, the snap fastener sockets have fluid drain holes which allow fluid, such as water, to drain from the snap fasteners. The present invention also pertains to related methods, such as methods of making and using self draining snap fasteners.

Snap fasteners and snap fastener sockets exist. However, existing snap fasteners and snap fastener sockets can be improved. Water and other liquids may enter the snap fasteners and snap fastener sockets. However, the snap fasteners and snap fastener sockets may not permit the liquids to easily drain out from inside of the snap fasteners and snap fastener sockets. Liquids, such as water, retained in the snap fasteners and snap fastener sockets can degrade the devices and cause reduced performance, and in some cases even failure.

Snap fasteners used in marine applications, for example, are exposed to water, including salt water. Water which does not readily drain from the snap fasteners may cause corrosion. Corrosion can be a problem even to snap fasteners made of corrosion resistant materials, such as stainless steel. Corrosion of the snap fasteners can cause the snap fasteners to not function as desired. The corroded snap fasteners may be difficult to snap onto a corresponding snap fastener stud and/or unsnap from the snap fastener stud. Corroded snap fasteners may not have sufficient holding strength to retain the snap connection to the snap fastener stud and may undesirably be easily and unintentionally removed from the snap fastener stud.

Also, water or other liquids retained inside of the snap fasteners and snap fastener studs may leave deposits, such a salt, as the liquids evaporate. Build-up of deposits inside of the snap fasteners and snap fastener studs can also degrade the performance of the devices.

Snap fasteners and snap fastener sockets have been oiled in attempts to address corrosion and build-up problems from retained liquids. However, oiling of snap fasteners and snap fastener sockets is time consuming, costly, requires manual application of the oil, requires repeated application of the oil and is generally not practical.

Accordingly, existing snap fasteners and snap fastener sockets have experienced problems and can be improved. Thus, needs exist to improve snap fasteners and snap fastener sockets for the reasons mentioned above and for other reasons.

SUMMARY OF THE INVENTION

The present invention provides new self draining snap fasteners and self draining snap fastener sockets which allow water and other liquids to drain from inside of the self draining snap fasteners and the self draining snap fastener sockets. The self draining snap fastener socket can be removably attached to another snap fastener member, such as a snap fastener stud. The self draining snap fastener socket has a snap action attachment/detachment portion defining a channel for a resilient snap member. The channel has an annular side wall extending generally along an axial direction of the self draining snap fastener socket, an upper flange extending from an upper portion of the annular side wall toward a socket center, and a lower flange extending from a lower portion of the annular side wall toward the socket center. A fluid passageway extends from the interior of the self draining snap fastener socket through the annular side wall to outside of the self draining snap fastener socket.

In an embodiment of the present invention, a self draining snap fastener socket has a snap action attachment/detachment portion and a mounting portion adjacent the snap action attachment/detachment portion. The snap action attachment/detachment portion has an annular side wall extending along an axial direction of the self draining snap fastener socket. The snap action attachment/detachment portion and the mounting portion define an interior of the snap fastener socket. A fluid passageway extends from the interior of the self draining snap fastener socket through the annular side wall to outside of the self draining snap fastener socket.

The fluid passageway may be a plurality of holes through the annular side wall. At least one hole of the plurality of holes may have an oblong shape. The oblong shape of the at least one hole may extend in generally the axial direction of the self draining snap fastener socket.

The snap action attachment/detachment portion of the self draining snap fastener socket may have a radial lower flange connected to the annular side wall. At least one hole of the plurality of holes may also extend through the radial lower flange.

The self draining snap fastener socket may also have a resilient snap member positioned within the snap action attachment/detachment portion. The resilient snap member may be at least one of a split ring and a parallel spring, or other suitable resilient member.

The self draining snap fastener socket may be at least partially made of a metal material and/or a plastic material.

In an embodiment of the present invention, a self draining snap fastener socket has a channel having an annular side wall, an upper flange extending from an upper portion of the annular side wall toward a socket center, and a lower flange extending from a lower portion of the annular side wall toward the socket center. A resilient snap member is positioned in the channel. A fluid drain hole is provided through the annular side wall of the channel.

The fluid drain hole may include a plurality of spaced-apart holes through the annular side wall. The holes may have an oblong shape. The oblong shape of the holes may extend in generally an axial direction of the self draining snap fastener socket. The holes may also extend through the lower flange.

The resilient snap member of the self draining snap fastener socket may be a split ring or a parallel spring, or other suitable resilient member.

The self draining snap fastener socket may be at least partially made of a metal material and/or a plastic material.

Embodiments of the present invention may have various features and provide various advantages. Any of the features and advantages of the present invention may be desired, but, are not necessarily required to practice the present invention.

Advantages of the present invention can be to provide new snap fasteners and new snap fastener sockets.

Further advantages of the present invention can be to provide self draining snap fasteners and self draining snap fastener sockets.

Another advantage of the present invention can be to automatically drain liquids from snap fasteners and snap fastener sockets.

A further advantage of the present invention can be to reduce corrosion of snap fasteners and snap fastener sockets.

Other advantages may include providing new methods of making and using snap fasteners and snap fastener sockets.

Additional features and advantages of the present invention are described in, and will be apparent from, the following Detailed Description of the Invention and the figures.

DETAILED DESCRIPTION OF THE INVENTION

Figure 1:
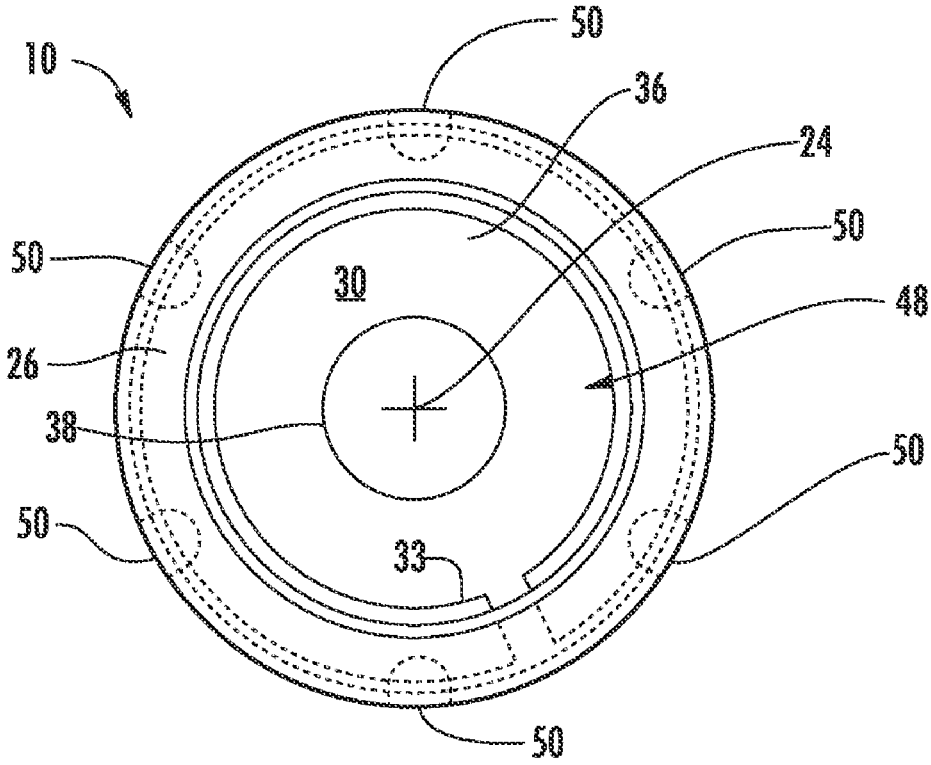
FIG. 1 is a top view of a self draining snap fastener socket having a fluid drain passageway according to the present invention.
Figure 2:
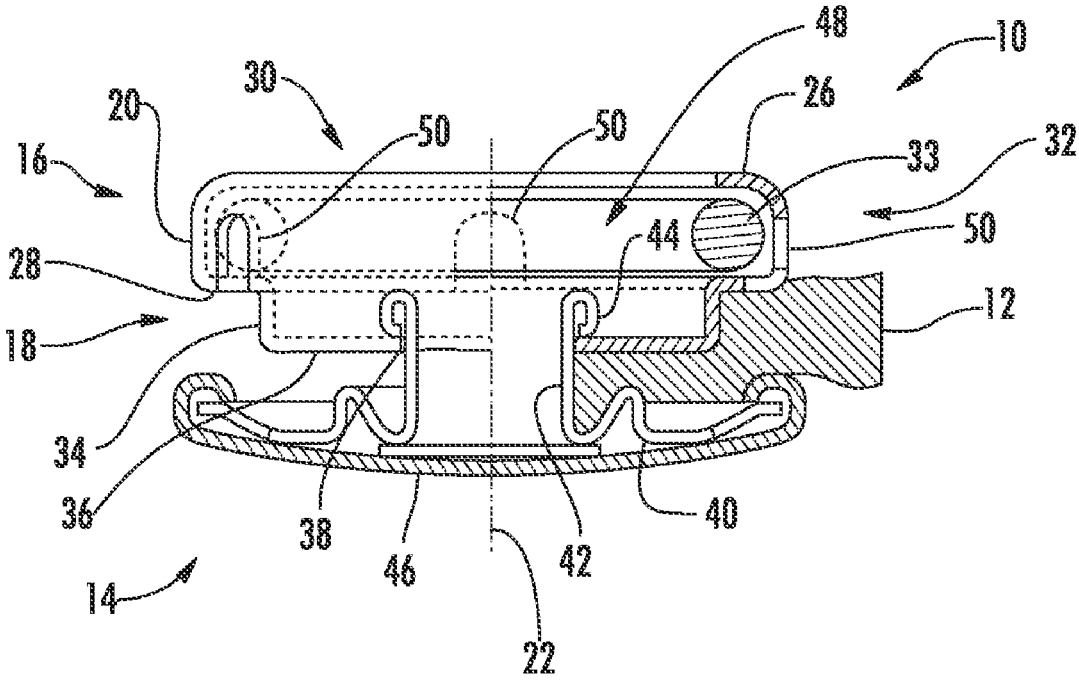
FIG. 2 is a front, cross-sectional view of the self draining snap fastener socket of FIG. 1 attached to a fabric by a socket attaching member.

One example of a snap fastener socket 10 according to the present invention is shown in FIGS. 1 and 2. The snap fastener socket 10 is a self draining snap fastener socket. FIG. 1 is a top view of the self draining snap fastener socket 10 according to the present invention. FIG. 2 is a front, cross-sectional view of the self draining snap fastener socket 10 of FIG. 1 attached to a fabric 12 by a socket attaching member 14. Although the self draining snap fastener socket 10 is surrounded by the fabric 12, a portion of the fabric 12 is omitted from FIG. 2 to more clearly show the self draining snap fastener socket 10.

The self draining snap fastener socket 10 has a snap action attachment/detachment portion 16 and a mounting portion 18. The snap action attachment/detachment portion 16 allows the self draining snap fastener socket 10 to be removably snapped onto a corresponding snap fastener stud. The snap action attachment/detachment portion 16 has an annular side wall 20 extending along an axial direction 22 of the self draining snap fastener socket 10 about a socket center 24, an upper flange 26 extending from an upper portion of the annular side wall 20 toward the socket center 24, and a lower flange 28 extending from a lower portion the annular side wall 20 toward the socket center 24. The upper flange 26 forms a snap fastener stud receiving hole 30 for the self draining snap fastener socket 10 to receive the snap fastener stud. The annular side wall 20, the upper flange 26 and the lower flange 28 form a channel 32 for a resilient snap member 33, such as a split ring (see also split ring 144 in FIGS. 5 and 6) or a parallel spring, for example. The resilient snap member 33 resiliently engages the corresponding snap fastener stud such that the self draining snap fastener socket 10 can be removably attached to the snap fastener stud, i.e., snapped onto the snap fastener stud and unsnapped from the snap fastener stud.

The mounting portion 18 of the self draining snap fastener socket 10 is adjacent the snap action attachment/detachment portion 16 and provides a mechanism to attach the self draining snap fastener socket 10 to another object, such as the fabric 12, by use of the socket attaching member 14. The mounting portion 18 has an annular neck 34 extending from the lower flange 28 of the snap action attachment/detachment portion 16 about the socket center 24 and generally in the axial direction 22 of the self draining snap fastener socket 10. The mounting portion 18 also has a lower flange 36 extending from a lower portion of the annular neck 34 toward the socket center 24.

The lower flange 36 of the mounting portion 18 has a hole 38 at the socket center 24 for receiving the socket attaching member 14. The socket attaching member 14 has a contoured radial flange 40 and a cylindrical post 42 extending from the contoured radial flange 40. A free end 44 of the cylindrical post 42 is inserted through the hole 38 of the lower flange 36 of the mounting portion 18 with the fabric 12 captured between the mounting portion 18 and the socket attaching member 14. The free end 44 of the socket attaching member 14 is deformed to securely attach the self draining snap fastener socket 10 to the fabric 12. The socket attaching member 14 may have a cap 46 attached to and covering the contoured radial flange 40.

The example of the socket attaching member 14 is a post-attached stud type attaching member. However, the present invention can be practiced using any other suitable attaching mechanisms, for example, a pronged type attaching member.

The self draining feature of the self draining snap fastener socket 10 will now be described in further detail. The self draining snap fastener socket 10 has an interior 48, which can be defined by the snap action attachment/detachment portion 16 and the mounting portion 18. The self draining snap fastener socket 10 has a structure which allows liquids, for example water, contained in the interior 48 of the self draining snap fastener socket 10 to automatically drain to outside of the self draining snap fastener socket 10. A fluid passageway 50 is provided to extend from the interior 48 of the self draining snap fastener socket 10 through the annular side wall 20 to outside of the self draining snap fastener socket 10. The fluid passageway 50 allows water and other liquids that enter the interior 48 of the snap fastener socket 10 to easily drain out of the interior 48. The fluid passageway 50 through the annular side wall 20 of the snap action attachment/detachment portion 16 provides an effective pathway for the fluids to drain from inside of the self draining snap fastener socket 10 because the fluid passageway 50 is relatively unobstructed. The resilient snap member 33 positioned in the channel 32 does not significantly obstruct the fluid passageway 50 and fluids can readily drain from the interior 48. Conversely, conventional snap fastener sockets do not have unobstructed fluid drain passageways. Liquids contained inside of conventional snap fastener sockets may not readily drain through the socket attaching member due to obstructions. Liquids contained inside of conventional snap fastener sockets may also not readily drain through the snap fastener stud receiving opening due to the obstruction of the snap fastener stud. Also, the side walls of the conventional snap fastener sockets do not have fluid passageways for draining fluid from inside of the snap fastener sockets.

Referring back to FIGS. 1 and 2, the self draining snap fastener socket 10 may have a plurality of fluid passageways 50. Each fluid passageway 50 may be a hole through the annular side wall 20 of the snap action attachment/detachment portion 16, and the holes 50 may be spaced-apart from each other at desired angular locations. The fluid passageway or hole 50 can have any shape or structure as desired. One example of a suitable hole 50 for the fluid passageway is a hole having an oblong shape. The oblong shaped hole 50 may extend in generally the axial direction 22 of the self draining snap fastener socket 10 as can be seen in FIG. 2. As can also be seen in FIG. 2, the hole 50 may also extend through the radial lower flange 28 of the snap action attachment/detachment portion 16. Any number of holes 50 having any shape and any location can be provided as desired.

Figure 3:
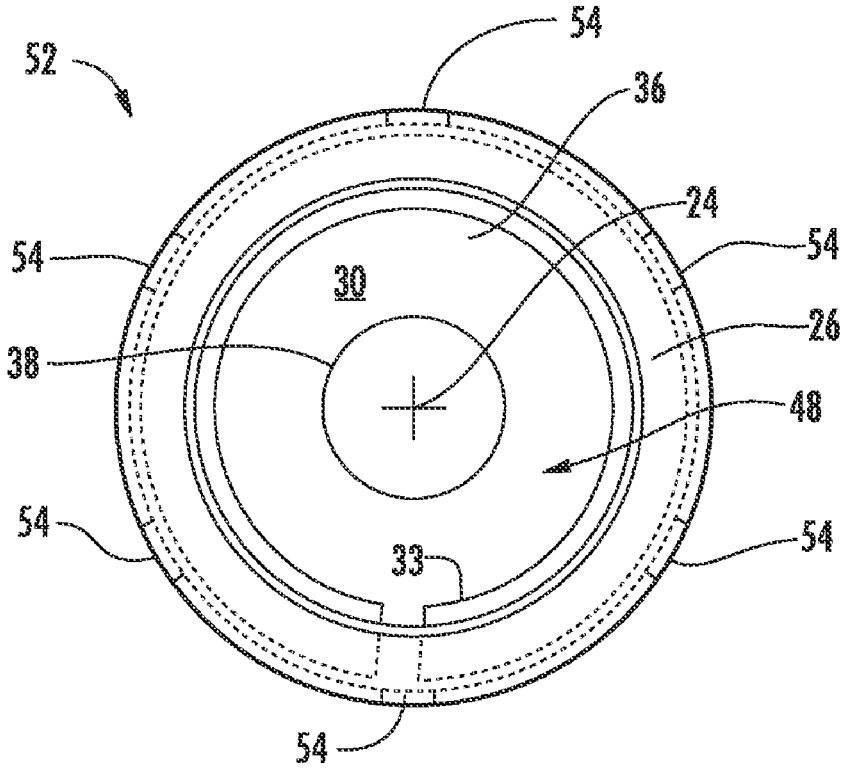
FIG. 3 is a top view of the self draining snap fastener socket having a variation to the fluid drain passageway.
Figure 4:
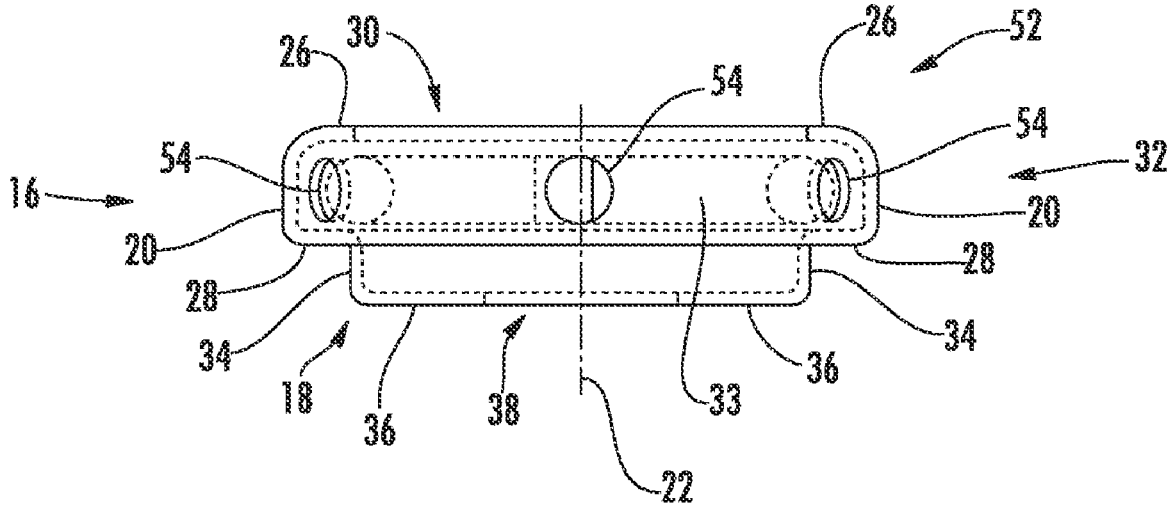
FIG. 4 is a front view of the self draining snap fastener socket of FIG. 3.

A variation to the self draining snap fastener socket is shown in FIGS. 3, and 4. FIG. 3 shows a top view of a self draining snap fastener socket 52 having a variation to the fluid drain passageways, and FIG. 4 is a front view of the self draining snap fastener socket 52 of FIG. 3. The self draining snap fastener socket 52 of FIGS. 3 and 4 is the same as the self draining snap fastener socket 10 of FIGS. 1 and 2 except for the fluid passageways. Accordingly, the same reference numbers are used for the self draining snap fastener socket 52 of FIGS. 3 and 4 as used in FIGS. 1 and 2 for like components.

The fluid passageways 54 in FIGS. 3 and 4 extend only through the annular side wall 20 of the snap action attachment/detachment portion 16. The fluid passageways 54 do not extend through the lower flange 28 of the snap action attachment/detachment portion 16. Also, the fluid passageways 54 are round shaped holes rather than oblong shaped holes.

Figure 5:
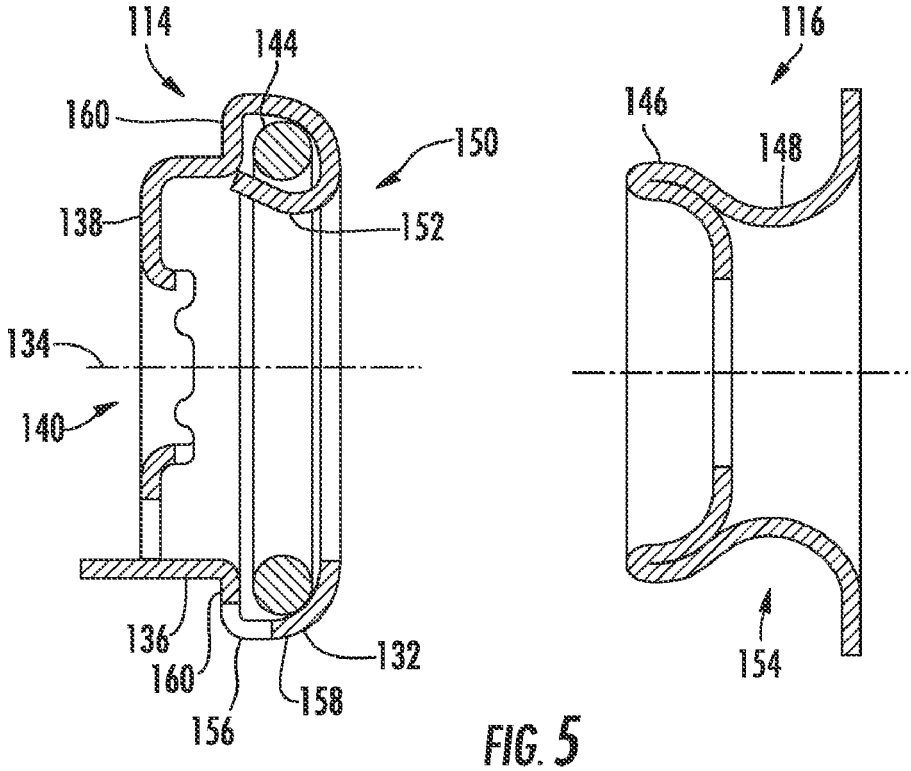
FIG. 5 is a cross-sectional view of a self draining snap fastener socket and a snap fastener stud according to the present invention, the self draining snap fastener socket and the snap fastener stud in a disengaged state.
Figure 6:
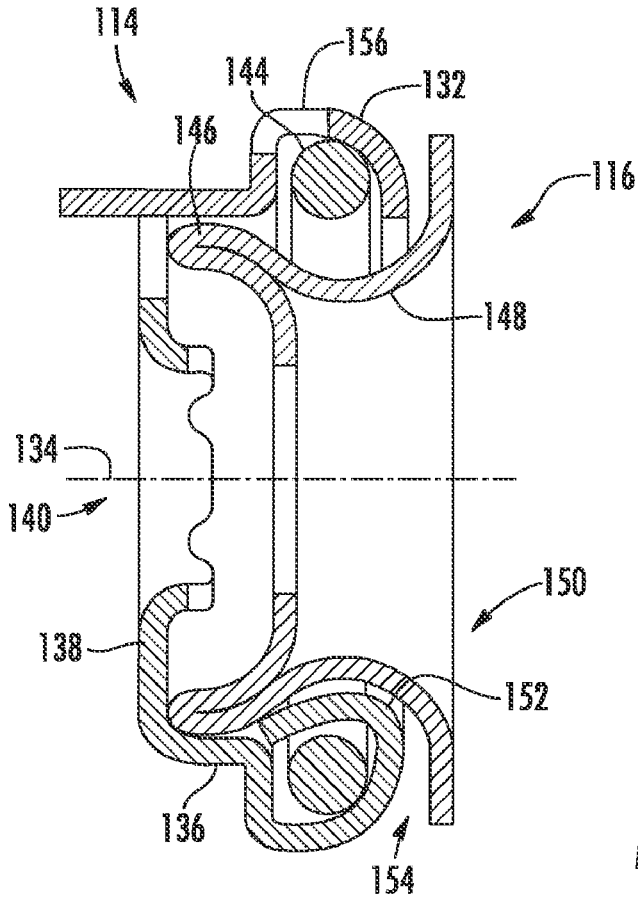
FIG. 6 is a cross-sectional view of the self draining snap fastener socket and the snap fastener stud of FIG. 5 in a snapped together state.

Referring to FIGS. 5 and 6, another self draining snap fastener socket 114 according to the present invention is shown. FIG. 5 shows a cross-sectional view of the self draining snap fastener socket 114 and a snap fastener stud 116 in which the self draining snap fastener socket 114 and the snap fastener stud 116 in a disengaged state. FIG. 6 shows a cross-sectional view of the self draining snap fastener socket 114 and the snap fastener stud 116 of FIG. 5 in a snapped together state.

The self draining snap fastener socket 114 has at one end a ring channel 132 which is open toward a socket center 134. A neck 136 extends from the ring channel 132 to an inward extending flange 138. The flange 138 has a hole 140 for mounting or attaching the self draining snap fastener socket 114 to another object, for example a buckle. Similar to FIG. 2, a post of the buckle or other socket attaching member can extend through the hole 140 in the flange 138 of the self draining snap fastener socket 114 and be deformed to attach to the self draining snap fastener socket 114.

The self draining snap fastener socket 114 has a split ring 144 positioned in the ring channel 132 and substantially exposed toward the socket center 134. The split ring 144 is a ring which is split at one location on the ring 144. The split allows the split ring 144 to resiliently flex open to a wider inside diameter and then to return to an unflexed inside diameter. The unflexed inside diameter of the split ring 144 is slightly smaller than the outer diameter of an enlarged diameter head 146 of the snap fastener stud 116. As the self draining snap fastener socket 114 is pressed onto the snap fastener stud 116, the split ring 144 flexes open and slips over the enlarged diameter head 146 of the snap fastener stud 116. As the snap fastener stud 116 is further inserted into the self draining snap fastener socket 114, the split ring 144 resiliently returns to its unflexed state when the split ring 144 is aligned with a reduced diameter neck 148 of the snap fastener stud 116 as shown in FIG. 6. Accordingly, the self draining snap fastener socket 114 is snap-fitted onto the snap fastener stud 116.

The self draining snap fastener socket 114 has fluid passageways 156 which allow fluids, such as water, to drain out from an interior of the self draining snap fastener socket 114. The fluid passageways 156 are shown as oblong holes through a sidewall 158 and flange 160 of the ring channel 132.

The self draining snap fastener socket 114 has an unsnap locking feature as disclosed in copending U.S. patent application Ser. No. 11/357,688, filed Feb. 17, 2006. Referring to FIG. 6, removal of the self draining snap fastener socket 114 from the snap fastener stud 116 is the reverse of the snap attaching except for the unsnap locking feature. An unsnap lock 150 is provided that permits the self draining snap fastener socket 114 to be unsnapped from the snap fastener stud 116 in only one direction. FIG. 6 shows the self draining snap fastener socket 114 snap-fitted to the snap fastener stud 116. The unsnap lock 150, which is a lip 152, is locked to the snap fastener stud 116 by being positioned in a narrowed diameter area 154 of the reduced diameter neck 148. The self draining snap fastener socket 114 and the snap fastener stud 116 can be unsnapped or separated by first starting the separation at a location opposite the lip 152. This is the unlocked direction. The portion of the split ring 144 opposite the lip 152 will slip over the enlarged diameter head 146 of the snap fastener stud 116 as the split ring 144 resiliently flexes to a larger diameter. The lip 152 still remains in the narrowed diameter area 154 of the reduced diameter neck 148 because the lip 152 does not flex sufficiently to slip over the enlarged diameter head 146. As the portion of the self draining snap fastener socket 114 opposite the lip 152 slips over the enlarged diameter head 146 and separates from the snap fastener stud 116, then the self draining snap fastener socket 114 can be further separated from the snap fastener stud 116 and the lip 152 is pulled out of the narrowed diameter area 154 of the reduced diameter neck 148.

The present invention can be practiced with many changes made to the disclosed examples of the self draining snap fastener socket. Also, any portion or portions of the self draining snap fastener socket or the entire self draining snap fastener socket can be made of any desired material or combination of materials. For example, the self draining snap fastener socket may be at least partially made of a metal material and/or a plastic material.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A self draining snap fastener socket, comprising:

a snap action attachment/detachment portion having an annular side wall extending generally along an axial direction of the self draining snap fastener socket, an upper flange extending from an upper portion of the annular side wall toward a socket center, and a lower flange extending from a lower portion of the annular side wall toward the socket center, wherein the annular side wall, the upper flange and the lower flange define a channel therebetween;

a resilient snap member positioned in the channel;

a mounting portion adjacent to the snap action attachment/detachment portion, the snap action attachment/detachment portion and the mounting portion defining an interior of the snap fastener socket; and a fluid passageway comprising at least one hole extending from the interior of the self draining snap fastener socket through the annular side wall to outside of the self draining snap fastener socket.

2. The self draining snap fastener socket of claim 1, wherein the at least one hole of the fluid passageway comprises a plurality of holes through the annular side wall.

3. The self draining snap fastener socket of claim 1, wherein the resilient snap member comprises at least one of a split ring and a parallel spring.

4. The self draining snap fastener socket of claim 1, wherein the self draining snap fastener socket is at least partially made of a metal material.

5. The self draining snap fastener socket of claim 1, wherein the self draining snap fastener socket is at least partially made of a plastic material.

6. The self draining snap fastener socket of claim 1, wherein the hole comprises a plurality of spaced-apart holes through the annular side wall.

7. The self draining snap fastener socket of claim 1, wherein the hole has an oblong shape.

8. The self draining snap fastener socket of claim 1, wherein the hole also extends through the lower flange.

9. The self draining snap fastener socket of claim 2, wherein at least one hole of the plurality of holes has an oblong shape.

10. The self draining snap fastener socket of claim 2, wherein at least one hole of the plurality of holes also extends through the lower flange.

11. The self draining snap fastener socket of claim 7, wherein the oblong shape of the hole extends in generally an axial direction of the self draining snap fastener socket.

12. The self draining snap fastener socket of claim 9, wherein the oblong shape of the at least one hole extends in generally the axial direction of the self draining snap fastener socket.

* * * * *